United States Patent [19]

Blakeslee et al.

[11] Patent Number: 4,480,658

[45] Date of Patent: Nov. 6, 1984

[54] ASPIRATOR SYSTEM FOR SOUND EMITTERS

[75] Inventors: Charles E. Blakeslee, Santa Ana, Calif.; Ingemar Alsenfelt, Malmö, Sweden

[73] Assignee: Kockumation AB, Sweden

[21] Appl. No.: 418,603

[22] Filed: Sep. 16, 1982

Related U.S. Application Data

[63] Continuation of Ser. No. 172,221, Jul. 25, 1980, abandoned.

[51] Int. Cl.[3] ..... F16K 43/00

[52] U.S. Cl. ..... 137/315; 137/240; 137/510; 137/895

[58] Field of Search ..... 137/240, 241, 315, 510, 137/605, 826, 895

[56] References Cited

U.S. PATENT DOCUMENTS

| | | | |
|---|---|---|---|
| 833,614 | 10/1906 | Mienswa | 137/240 |
| 2,175,652 | 10/1939 | Trier | 137/240 |
| 3,499,461 | 3/1970 | Tuma | 137/240 |
| 4,248,692 | 2/1981 | Knebel | 137/240 X |

*Primary Examiner*—Harold W. Weakley

*Attorney, Agent, or Firm*—Blakely, Sokoloff, Taylor & Zafman

[57] ABSTRACT

A fluid operated pressure oscillation generator having an additional inlet passage to permit removal of a cover.

11 Claims, 7 Drawing Figures

ASPIRATOR SYSTEM FOR SOUND EMITTERS

This is a continuation of application Ser. No. 172,221, filed July 25, 1980 now abandoned.

BACKGROUND OF THE INVENTION

1. Field of the Invention

The present invention relates to fluid operated pressure oscillation generators of the type wherein a diaphragm is biased against a seat in a diaphragm housing by means of a cover detachably mounted to the housing and engaging the diaphragm at the periphery thereof. When a pressure fluid such as pressurized air is supplied to an inlet compartment in the diaphragm housing, surrounding the seat, the diaphragm operates as a valve in cooperation with the seat to control the fluid flow to an outlet passage inside the seat, which joins a resonator, such as a resonator horn.

2. Description of the Prior Art

Pressure oscillation generators of this kind are used for cleaning spaces in furnaces and process apparatus as well as other similar spaces through which gases are flown such as hot flue gases from combustion processes and exhaust and waste gases from chemical processes with dust and other fine particulate material entrained therein, which tends to deposit on the surfaces of the space passed by the gas and to form a coating on such surfaces. The coating forms an insulation layer on the heat exchange surfaces of the furnace or apparatus and therefore should be removed continuously or intermittently in order to maintain a high heat exchange efficiency. This type of cleaning is often called "sonic cleaning".

In sonic cleaning the coatings which may be hard and compact and may firmly adhere to the surfaces are actuated mechanically by the air propagated pressure oscillations transmitted from the pressure oscillation generator so as to be loosened from the surfaces and fall down to the bottom of the space to be cleaned. The oscillations involved may have a frequency in the audible frequency range or in the infrasonic frequency range (below about 20 cps).

When pressure oscillation generators of the type referred to are used for sonic cleaning in the manner described they are mounted in a wall of the space to be cleaned with the resonator opening into the space to transmit the pressure oscillations thereinto, while the diaphragm housing is located on the outside of the wall. Since the generator is subject to normal wear and also may be exposed to abnormal temperature conditions due to heat radiation from the space to be cleaned, it must be serviced from time to time for maintenance and repair including replacement of wearing parts usually the diaphragm which is the most easily damaged element of the generator. Then, it is of course necessary to remove the cover engaging the diaphragm, and when the cover as well as the diaphragm are removed from the housing, a connection will be established between the space to be cleaned and the surrounding atmosphere through the resonator and the passage inside the seat. If the space is at over-pressure as it usually is, hot and/or health-endangering gases may be expelled from the space as a back flow through the diaphragm housing in the form of a focused jet which may hit the person servicing the generator.

SUMMARY OF THE INVENTION

The primary object of the invention is to provide a fluid operated pressure oscillation generator of the type referred to wherein such back flow through the diaphragm housing is effectively prevented.

A further object is to provide a fluid operated pressure oscillation generator wherein a continuous gas flow is provided through the passage inside the seat and through the resonator connected thereto, when the cover and the diaphragm are removed from the diaphragm housing so as to hold back or impede the gas pressing from the interior of the space to be cleaned.

Another object of the invention is to provide a fluid operated pressure oscillation generator wherein a pressurized gas such as air can be directed into the space to be cleaned when the cover and the diaphragm are removed from the diaphragm housing, without interference with the service work to be done. More particularly the seat will be fully exposed and available for servicing during the supply of the pressurized gas.

Additional objects and advantages of the invention in part will be set forth in the description which follows and in part will be obvious from the description, or may be learned by practice of the invention. The objects and advantages of the invention may be realized and attained by means of the instrumentalities and combinations particularly pointed out in the appended claims.

The accompanying drawings which are incorporated in and constitute a part of this specification, illustrate several embodiments of the invention and, together with the description, serve to explain the principles of the invention.

Reference will now be made in detail to the present preferred embodiments of the invention, examples of which are illustrated in the accompanying drawings.

Figure 1:
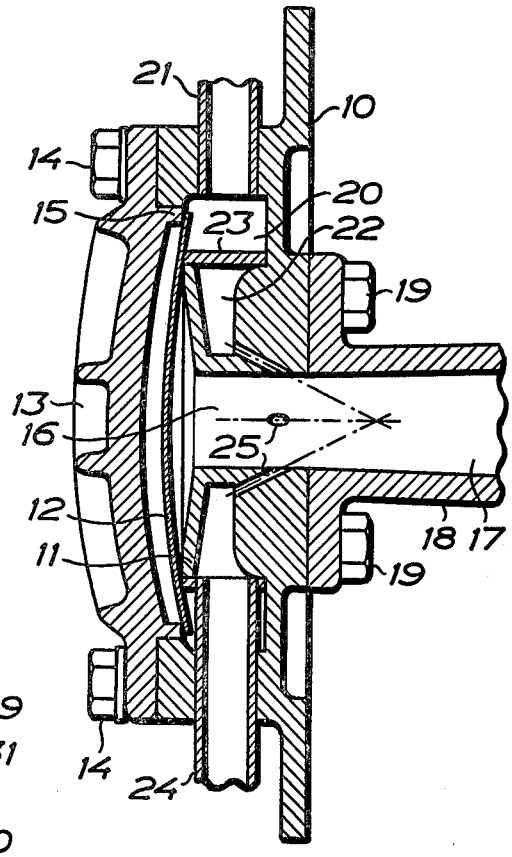
FIG. 1 is an axial cross sectional view of a pressure oscillation generator illustrating one embodiment of the invention.

The fluid operated pressure oscillation generator disclosed in FIG. 1 comprises a diaphragm housing 10 which forms an annular seat 11. A diaphragm 12 is biased against the seat by means of a cover 13 mounted to the housing by means of screws or bolts 14, a circumferential rib 15 on the inner side of the cover engaging the diaphragm at the periphery thereof. Inside the seat 11 the housing 10 forms a central passage 16, and the passage 17 of a resonator horn 18 connected to the housing by screws 19 forms an extension of the central passage 16. An annular inlet compartment 20 surrounding the seat is provided with a tube connection 21 for the supply of pressurized gas such as air to the inlet compartment.

When pressurized gas is supplied to the inlet compartment 20 the diaphragm 12 in cooperation with the seat 11 controls the gas flow from the inlet compartment 20 to the central passage 16 in the housing 10 and thus to the passage 17 of the resonator horn 18 for the generation of air propagated pressure oscillations transmitted from the opening of the resonator horn 18, in a manner which is well known in the art.

The diaphragm housing 10 forms a further annular compartment 22 between the passage 16 and the inlet compartment 20 a partition wall 23 being connected to the housing as by welding between compartments 16 and 22. A tube connection 24 is provided for the supply of pressurized air to the inner compartment 22, and this compartment has a number of outlet bores 25 opening into the passage 16. These bores converge towards a common point on the axis of the passage 16 and are directed towards the outlet end thereof, which is connected to the resonator horn. The bores 25 each include an angle of the order of 25° with the axis of the passage, and they are equally spaced around the passage. The number thereof is four but any other suitable number of bores may be provided.

When the generator is mounted to the wall of a space to be cleaned from dust coatings by sonic cleaning as described above, and the cover 13 is dismounted from the housing 10 for maintenance or repair of the interior of the generator, then a flow connection is established between the interior of the space and the surroundings. In order to hold back gases under overpressure tending to escape through passages 16 and 17 as a hot and health-endangering jet, pressurized gas such as air is supplied through the pipe connection 24 to the inner compartment 22. The gas will be delivered to the passages 16 and 17 through the bores and will form a curtain therein which prevents gases under overpressure in the space to be cleaned from passing from said space to the surroundings through the passages. Thus, the workman servicing the generator can perform his work without being hit by an inconvenient or even dangerous gas flow from the space to be cleaned.

The embodiment described operates in a satisfactory manner in order to achieve the objects of the invention. However, the housing must be of a specific construction including the partition wall 23, and the arrangement of such wall makes the manufacture of the housing more complicated. In other words, a specifically constructed housing must be included in a fluid operated pressure oscillation generator which is to be used for sonic cleaning under the conditions described.

Figure 2:
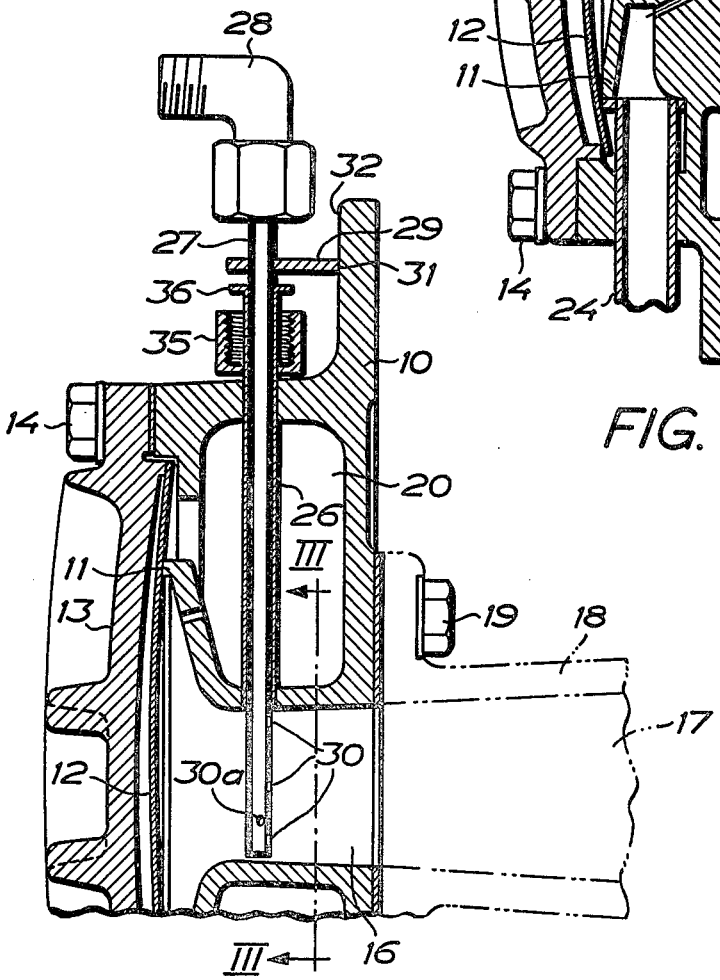
FIG. 2 is a fragmentary axial cross sectional view of a pressure oscillation generator illustrating a second embodiment of the invention.
Figure 3:
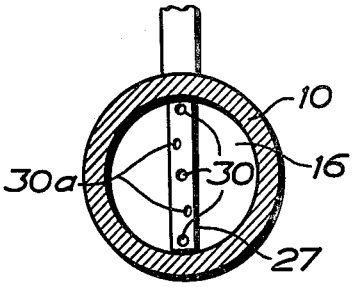
FIG. 3 is a cross sectional view taken along line III—III in FIG. 2.
Figure 4:
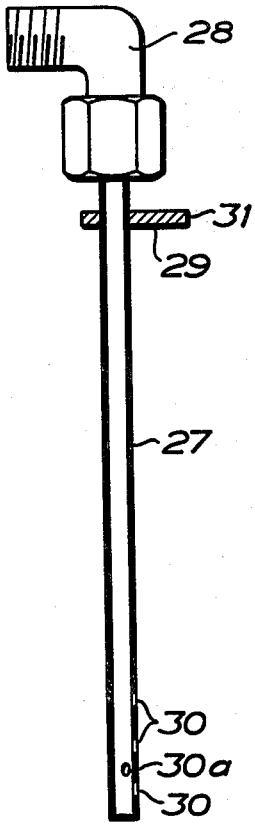
FIG. 4 is a side view of a nozzle forming part of the embodiment in FIGS. 2 and 3.

FIGS. 2 to 4 disclose an embodiment including a standard diaphragm housing which has been modified in a simple manner for the purpose of the invention.

Figure 5:
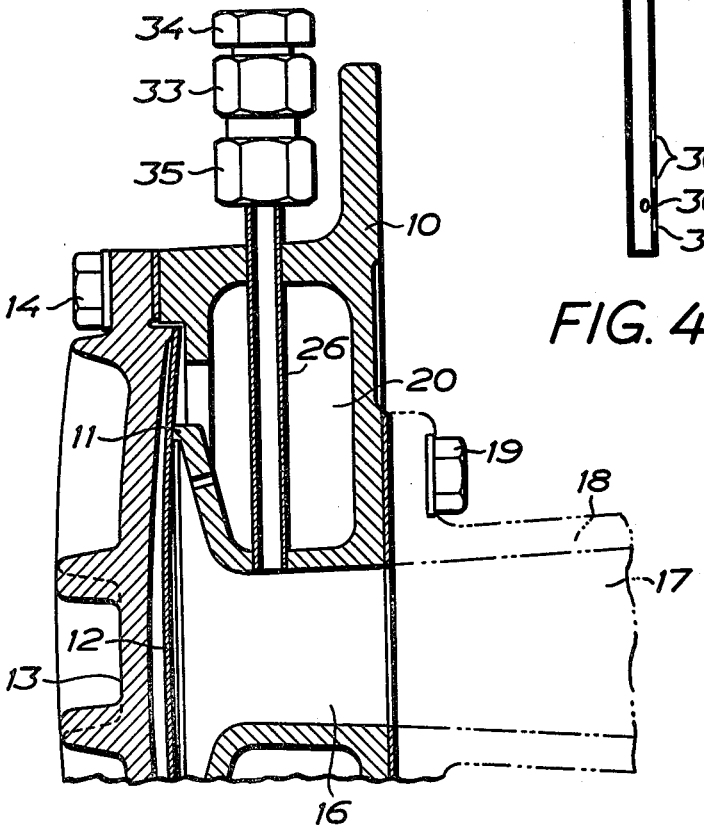
FIG. 5 is a view as that in FIG. 2 the nozzle being withdrawn from the diaphragm housing.

As shown in FIGS. 2 and 5 a tube 26 extends from the outside of the diaphragm housing 10 through the inlet compartment 20, the opposite open ends of the tube communicating with the surroundings and the passage 16, respectively. The tube 26 is fixedly connected to the housing as by welding and the inner end thereof is flush with the bounding surface of the passage 16. A tubular nozzle 27, FIGS. 2 to 4, is inserted into the tube 26 and has a slide fit therein. The nozzle, shown separately in FIG. 4, has a bend 28 at the outer end thereof for connection to a source of pressurized gas such as air, and a guide flange 29 is fixedly connected to the nozzle. The closed inner end of the nozzle abuts the inside wall of the passage 16, and the portion of the nozzle extending across the passage 16 is formed with outlet bores 30, which are directed axially of the passage 16 into the passage 17 of the resonator horn 18, and outlet bores **30*a* which form an angle with the axis of said bore and are also directed into the passage 17 of the resonator horn. An edge 31 on the guide flange 29 cooperates with a surface 32 on the diaphragm housing in order to accurately define the rotational position of the nozzle when it is inserted into the tube 26 so that the bores 30 and 30*a*** will be directed as described.

When pressurized gas is supplied to the nozzle the gas discharged from the nozzle bores 30 and **30*a* will form a gas curtain in the passages 16 and 17 in the manner described with reference to FIG. 1 so as to prevent gas from passing out through said passages from the space to be cleaned when the cover 13 and the diaphragm 12** are removed from the housing.

When the pressure oscillation generator is in the operative position the nozzle is withdrawn from the tube 26 and as shown in FIG. 5 the outer end of the tube 26 is closed by means of a female connector 33 having a screw plug 34 therein, which is mounted to the tube 26 by means of a coupling nut 35 cooperating with an annular end flange 36 at the outer end of the tube 26.

As will be seen from FIGS. 2 to 5 a standard diaphragm housing can easily be modified by arranging the tube 26 therein for the purpose of the invention. Since the nozzle is a separate part it can be used for servicing several generators.

Figure 6:
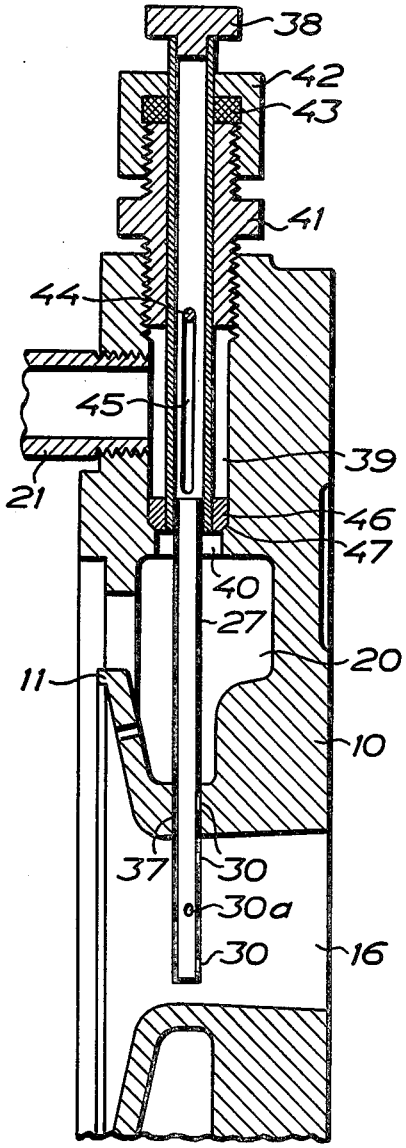
FIG. 6 is a fragmentary axial sectional view of a third embodiment of the invention, shown in a maintenance condition.
Figure 7:
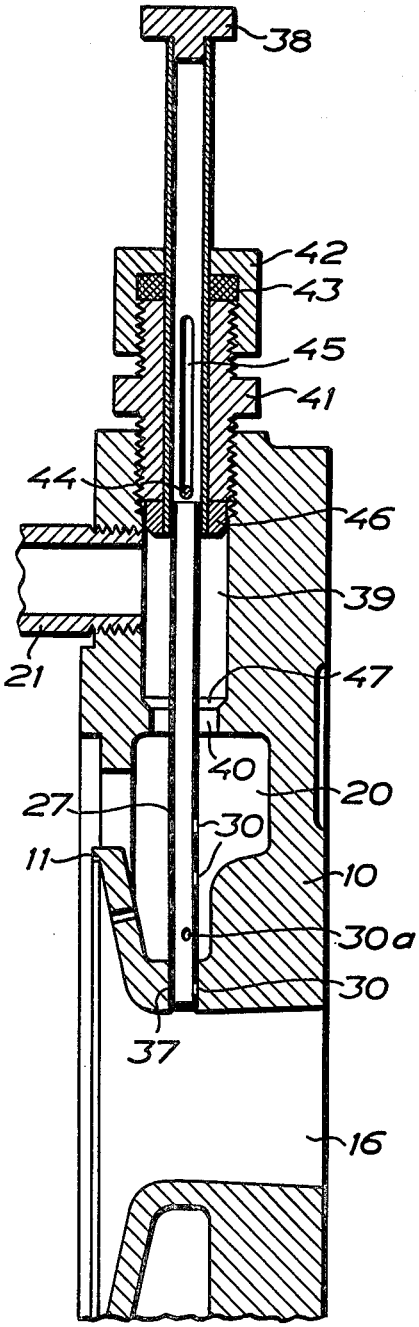
FIG. 7 is a view similar to that in FIG. 6, illustrating the normal operative condition of the generator.

A more elaborate embodiment of the invention is shown in FIGS. 6 and 7 and can be considered as a further development of the embodiment of FIGS. 2 to 5.

According to this embodiment the nozzle 27 comprising two tubes connected together in axial alignment, has a slide fit in a guide bore 37 in the diaphragm housing 10 between the inlet compartment 20 and the passage 16. The outer end of the nozzle is closed by a plug 38, FIG. 6, and at the inner end which is also closed, bores 30 and **30*a* are arranged as described with reference to the embodiment of FIGS. 2 to 5. The nozzle extends through an inlet passage 39 communicating with the tube inlet 21 opening in the side wall of said passage. One end of the passage 39 opens into the inlet compartment 20 through an opening 40, and at the other end a male connector 41 is screwed into the passage. The nozzle extends through this male connector 41, and a screw gland 42 is mounted at the outer end of the connector, a packing material 43 being arranged therein. A cross pin 44 mounted in the housing 10 extends through opposite elongated axial slots 45 in the nozzle in order to define the rotational position of the nozzle so that the bores 30 and 30*a*** are maintained in the desired position.

A valve head 46 is fixedly connected to the nozzle and is slidable in the passage 39. In the position shown in FIG. 6 the valve head 46 engages a seat 47 formed in the passage 39 at the opening 40 in order to close the passage to the inlet compartment 20. When the nozzle is in this displaced position pressurized gas such as air can be supplied to the inlet passage 39 from the tube inlet 21 and will pass through the slots 45 into the nozzle 27 to be discharged in the passage 16 through the bores 30 and **30*a*. No gas can pass through the passage 39 into the inlet compartment 20 because the communication between said passage and the inlet compartment 20 is interrupted by the valve head 46 engaging the seat 47. As will be understood the valve head will be biased against the seat by the pressure of the gas supplied to the inlet passage. The position of the nozzle shown in FIG. 6 accordingly is that used for producing the gas curtain in the passage 16** when it is desired to remove the cover and the diaphragm (not shown in FIGS. 6 and 7) as described above.

In the operative condition of the pressure oscillation generator the nozzle 27 is withdrawn to the position shown in FIG. 7 in which the inlet passage 39 communicates with the inlet compartment and the generator can be operated in the conventional way. The slots 45 are displaced from the inlet passage and are received in the connector 41 so that no gas can pass into the nozzle through said slots. The inner end of the nozzle closes the guide bore 37, so that no gas can pass into the passage 16 through the guide bore. Gas passing from the inlet compartment 20 into the nozzle through the bores 30 and 30*a* has no way out of the nozzle. The gland 42 can be tightened in order to lock the nozzle in either position thereof, if necessary.

It will be apparent to those skilled in the art that various other modifications and variations could be made in the fluid operated pressure oscillation generator without departing from the scope and spirit of the invention.

We claim:

1. A fluid operated pressure oscillation generator comprising a housing forming an outlet passage and an inlet compartment surrounding said outlet passage, one end of said outlet passage disposed adjacent a source of gas under pressure; an annular seat formed by said housing between the outlet passage and the inlet compartment; a diaphragm; a cover detachably mounted to the housing and engaging the diaphragm at the periphery thereof to bias the diaphragm against the seat, said diaphragm forming a valve controlling a fluid connection between the inlet comparting and the other end of the outlet passage; at least one bore for a fluid, said bore opening into said outlet passage and facing away from the diaphragm, wherein said bore is disposed such that it passes through a wall separating said inlet compartment and said outlet passage, and means for injecting said latter fluid through said bore from the outside of the diaphragm housing into said outlet passage, whereby said latter fluid injected through said bore prevents the flow of gas under pressure from said outlet passage to the area external to said generator when said cover is detached.

2. A fluid operated pressure oscillation generator as claimed in claim 1 further comprising a nozzle; and means mounting said nozzle for axial displacement through the housing, said nozzle having one end outside the housing and the other end in said outlet passage, wherein said bore is disposed in a part of the nozzle extending across the outlet passage at said other end of the nozzle.

3. A fluid operated pressure oscillation generator as claimed in claim 2 further comprising a guide tube in said housing, extending between the outside of the housing and the outlet passage in the transverse direction of said passage, said nozzle being slidable through said guide tube.

4. A fluid operated pressure oscillation generator comprising:

(a) a housing forming an outlet passage and an inlet compartment surrounding said outlet passage, one end of said outlet passage disposed adjacent a source of gas under pressure;

(b) an annular seat formed by said housing between the other end of said outlet passage and the inlet compartment;

(c) a diaphragm adjacent to said annular set;

(d) a cover detachably mounted to the housing and adapted to engage the diaphragm at the periphery thereof to bias the diaphragm against the seat, said diaphragm forming a valve controlling a fluid connection between the inlet compartment and the outlet passage;

(e) means for preventing the flow of gases under pressure from said outlet passage to the surroundings when said cover is detached from said housing.

5. The fluid operated pressure oscillator generator defined in claim 4 wherein said preventing means comprises at least one bore through a wall of said inner compartment, which bore provides a fluid connection between said inner compartment and said outlet passage, and means for injecting a fluid through said bore into said outlet passage, whereby when said cover is detached, the flow of gases under pressure from said outlet passage to the surroundings is prevented.

6. The fluid operated pressure oscillation generator defined in claim 5 wherein there are a plurality of said bores, each including an angle of approximately 25° with the axis of the outlet passage, substantially equally spaced around the outlet passage.

7. The fluid operated pressure oscillator generator defined in claim 4 wherein said preventing means comprises a nozzle and means mounting said nozzle for axial displacement through the housing, said nozzle having one end outside the housing and the other end in said outlet passage, said bore being disposed on said other end of the nozzle in said outlet passage.

8. The fluid operated pressure oscillator generator defined in claim 7 further comprising a guide tube in said housing extending between the outside of the housing and the outlet passage in the transverse direction of said passage, said nozzle being slidable through said guide tube.

9. The fluid operated pressure oscillator generator defined by claim 8 wherein there are a plurality of said bores, at least one of said plurality of bores directed axially of the outlet passage, and at least one of said plurality of bores forming an angle with the axis of said axially directed bore.

10. The fluid operated pressure oscillator generator defined by claim 9 wherein a guide flange coupled to the nozzle is adapted to cooperate with a surface on the housing to define the rotational position of the nozzle with respect to the guide tube, whereby the bores will be directed axially and at an angle as aforesaid.

11. A fluid operated pressure oscillation generator comprising:

(a) a housing forming an outlet passage and an inlet compartment surrounding said outlet passage;

(b) an annular seat formed by said housing between said outlet passage and the inlet compartment;

(c) a diaphragm adjacent to said annular seat;

(d) a cover detachably mounted to the housing and adapted to engage the diaphragm at the periphery thereof to bias the diaphragm against the seat, said diaphragm forming a valve controlling a fluid connection between the inlet compartment and the outlet passage;

(e) means for preventing the flow of gases under pressure from said outlet passage to the surroundings when said cover is detached from said housing.

* * * * *